US011592030B2

(12) United States Patent
Kang et al.

(10) Patent No.: US 11,592,030 B2
(45) Date of Patent: Feb. 28, 2023

(54) FAN ASSEMBLY AND WASHING MACHINE HAVING THE SAME

(71) Applicant: SAMSUNG ELECTRONICS CO., LTD., Suwon-si (KR)

(72) Inventors: Yong Hun Kang, Seoul (KR); Geon Ung Lee, Hwaseong-si (KR); Hwang Mook Cho, Suwon-si (KR); Jin Baek Kim, Hwaseong-si (KR); Eung Ryeol Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 709 days.

(21) Appl. No.: 16/479,002

(22) PCT Filed: Dec. 7, 2017

(86) PCT No.: PCT/KR2017/014298
§ 371 (c)(1),
(2) Date: Dec. 16, 2019

(87) PCT Pub. No.: WO2018/135751
PCT Pub. Date: Jul. 26, 2018

(65) Prior Publication Data

US 2020/0141048 A1 May 7, 2020

(30) Foreign Application Priority Data

Jan. 18, 2017 (KR) ..... 10-2017-0008632

(51) Int. Cl.
*D06F 58/20* (2006.01)
*D06F 58/04* (2006.01)
(Continued)

(52) U.S. Cl.
CPC ..... *F04D 29/30* (2013.01); *D06F 29/005* (2013.01); *D06F 58/04* (2013.01); *D06F 58/20* (2013.01);
(Continued)

(58) Field of Classification Search
CPC ..... D06F 58/04; D06F 58/20; D06F 29/005; D06F 25/00; D06F 58/206; F04D 29/282; F04D 29/30; F04D 29/281
See application file for complete search history.

(56) References Cited

U.S. PATENT DOCUMENTS

2003/0051515 A1* 3/2003 Woo ..... D06F 25/00 68/20
2012/0090189 A1* 4/2012 Kwon ..... D06F 25/00 34/82
(Continued)

FOREIGN PATENT DOCUMENTS

JP 2011-167428 9/2011
JP 2013-192659 9/2013
(Continued)

OTHER PUBLICATIONS

International Search Report dated Mar. 30, 2018 in corresponding International Application No. PCT/KR2017/014298, 5 pages.
(Continued)

*Primary Examiner* — Benjamin L Osterhout
(74) *Attorney, Agent, or Firm* — Staas & Halsey LLP

(57) ABSTRACT

The washing machine includes a cabinet, a drum installed inside the cabinet, and a fan assembly to guide heated air into the drum. A fan assembly includes a shroud provided with an air inlet hole, a hub rotated by a driving motor, a plurality of blades provided along a circumferential direction of the hub to guide the air introduced through the air inlet hole in the circumferential direction of the hub, and a
(Continued)

scroll guiding the air guided in the circumferential direction of the hub into the drum. A partition wall prevents the air guided in the circumferential direction of the hub from being re-introduced into the air inlet hole. The blade includes a shroud contact portion in contact with the shroud and a hub contact portion in contact with the hub. An inflection point is formed between the shroud contact portion and the hub contact portion.

14 Claims, 12 Drawing Sheets

(51) Int. Cl.

| | |
|---|---|
| ***D06F 29/00*** | (2006.01) |
| ***F04D 29/28*** | (2006.01) |
| ***F04D 29/30*** | (2006.01) |
| *D06F 25/00* | (2006.01) |

(52) U.S. Cl.
CPC ..... *F04D 29/282* (2013.01); *D06F 25/00* (2013.01); *D06F 58/206* (2013.01)

(56) References Cited

U.S. PATENT DOCUMENTS

| | | | | |
|---|---|---|---|---|
| 2016/0017534 | A1* | 1/2016 | Yu | D06F 58/20 34/604 |
| 2016/0177489 | A1* | 6/2016 | Ahn | D06F 58/203 68/5 C |
| 2016/0237613 | A1* | 8/2016 | Lee | D06F 58/22 |
| 2019/0242397 | A1* | 8/2019 | Adachi | F04D 29/441 |

FOREIGN PATENT DOCUMENTS

| | | |
|---|---|---|
| KR | 2000-0074207 | 12/2000 |
| KR | 10-2004-0069111 | 8/2004 |
| KR | 10-2009-0086640 | 8/2009 |

OTHER PUBLICATIONS

Written Opinion of the International Searching Authority dated Mar. 30, 2018 in corresponding International Application No. PCT/KR2017/014298, 3 pages.

* cited by examiner

【Figure 1】
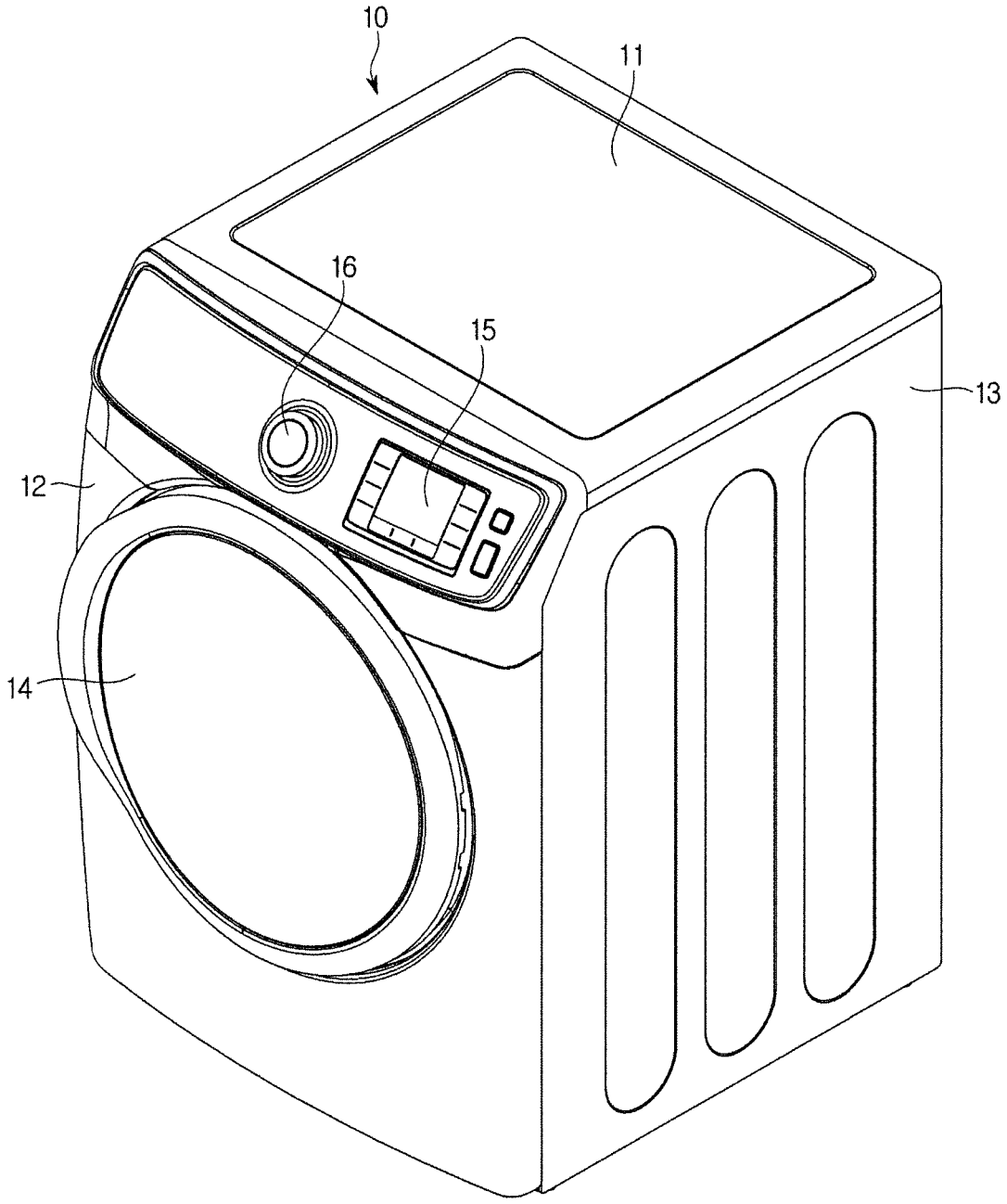

【Figure 2】
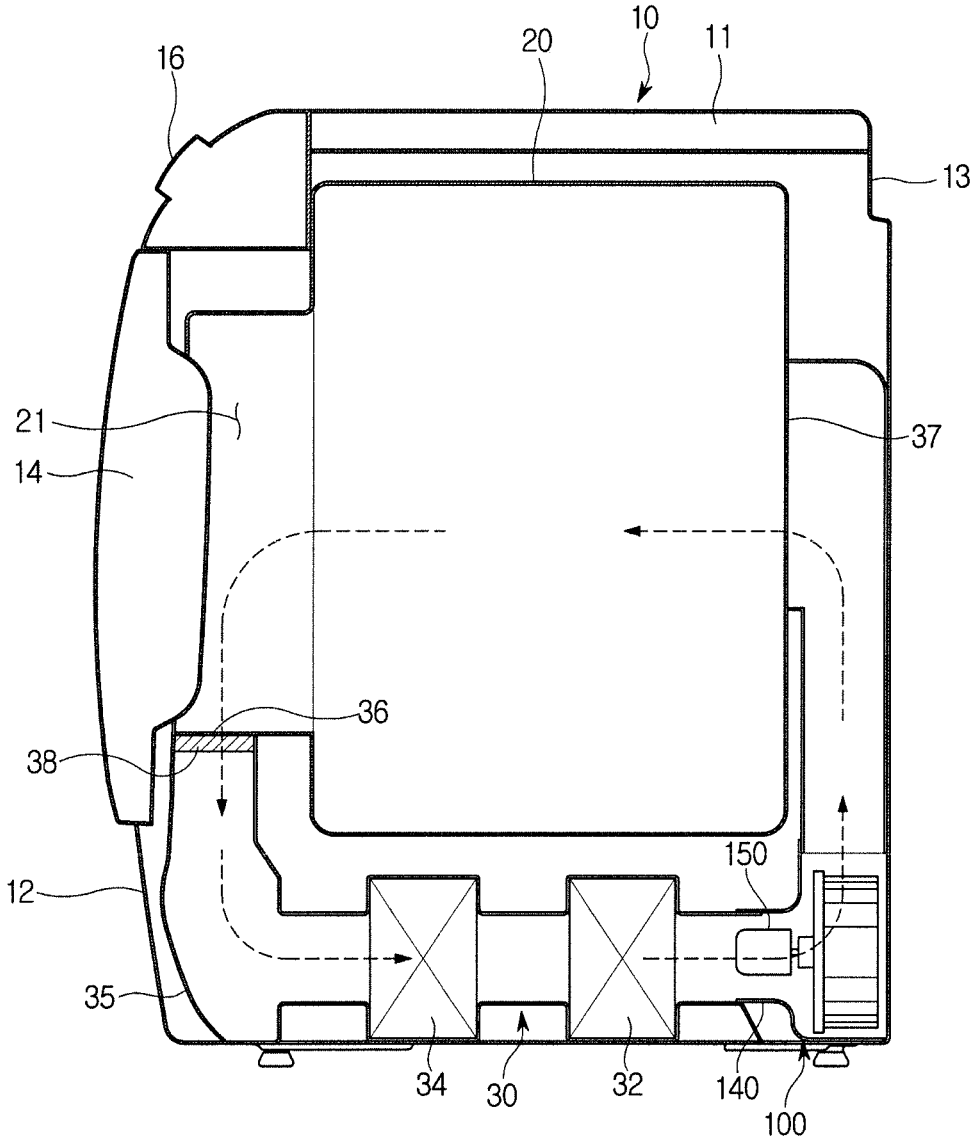

【Figure 3】
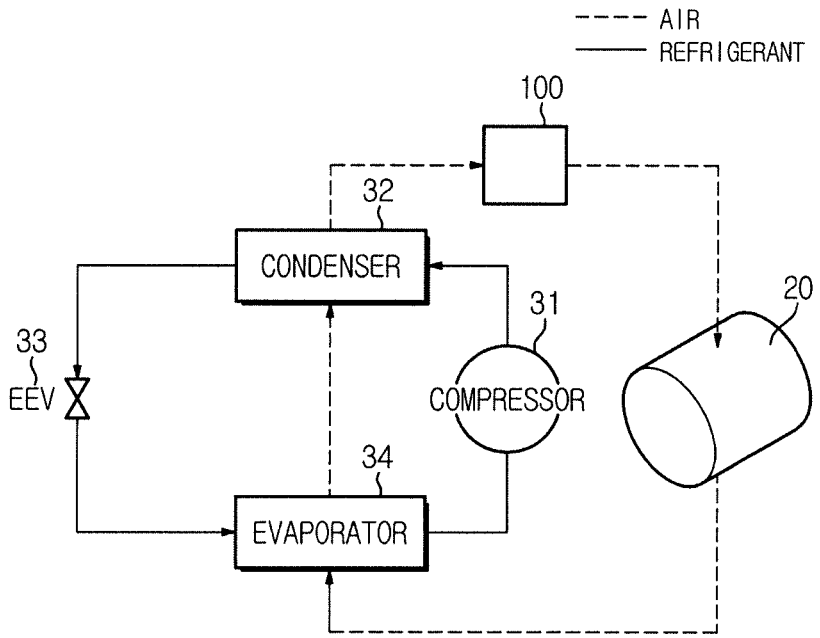

【Figure 4】
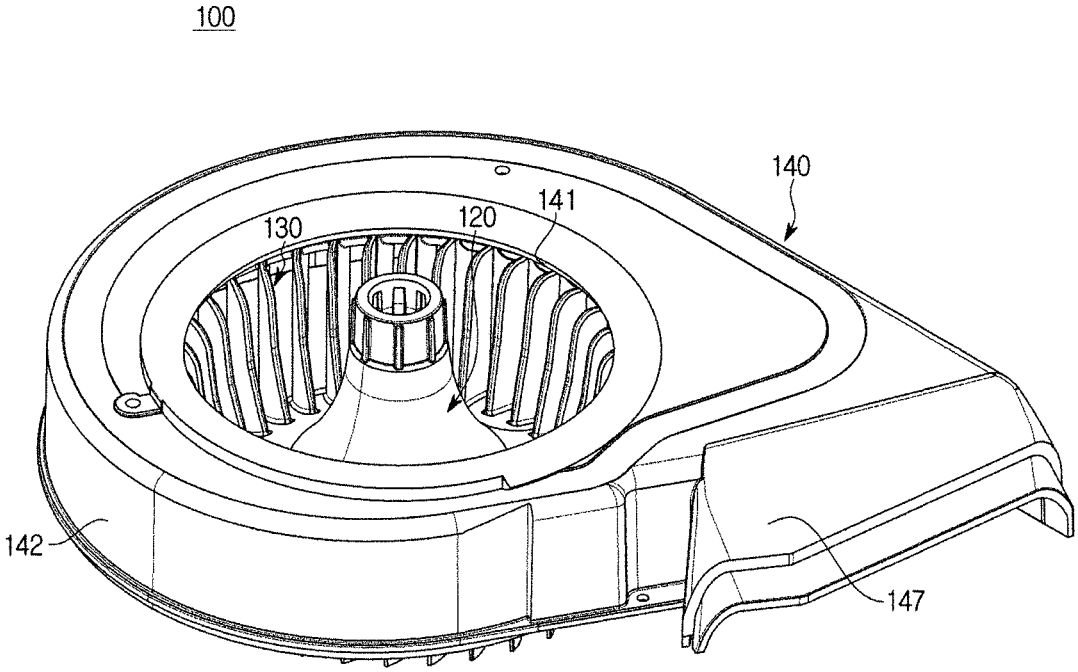

【Figure 5】
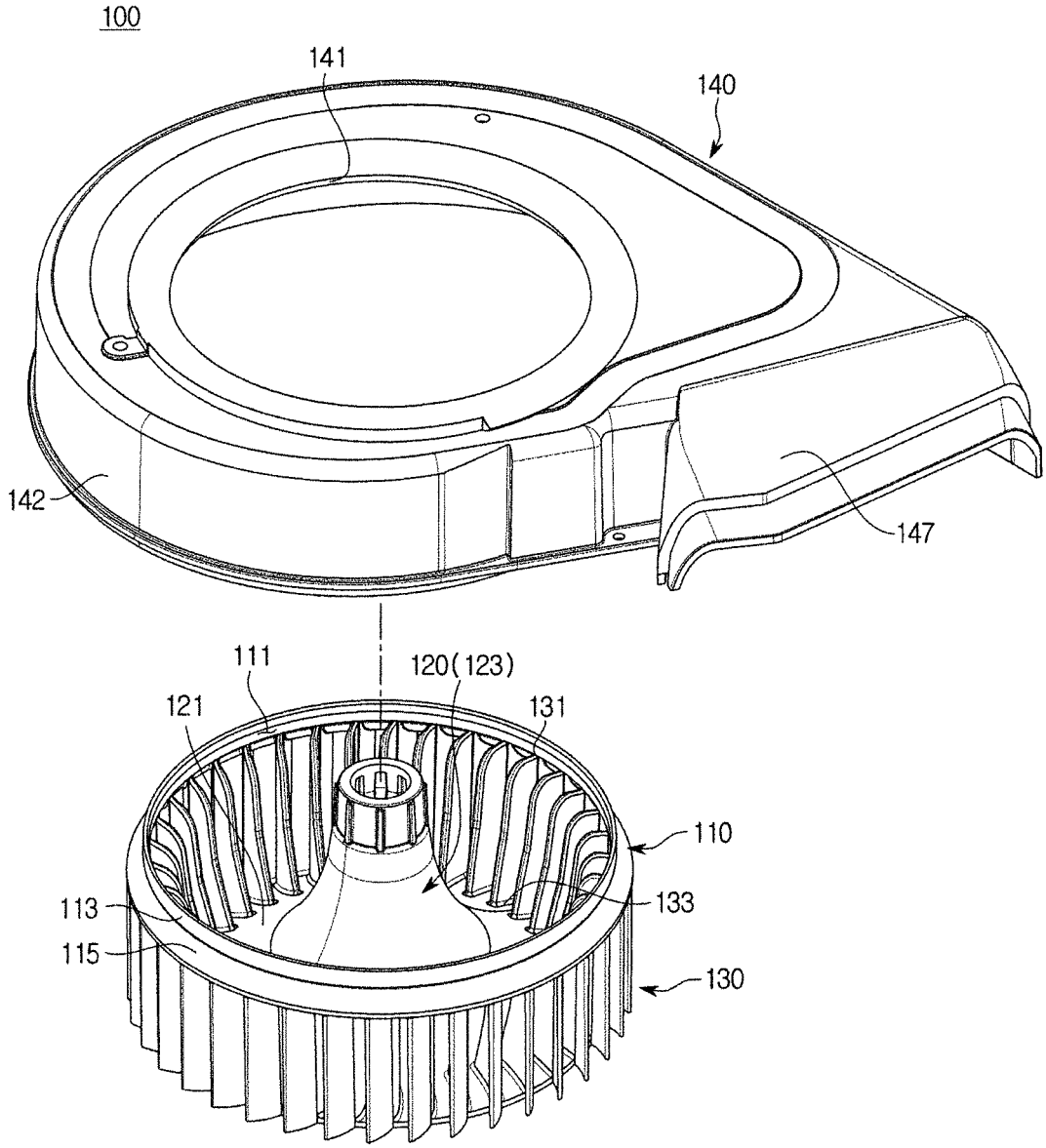

【Figure 6】
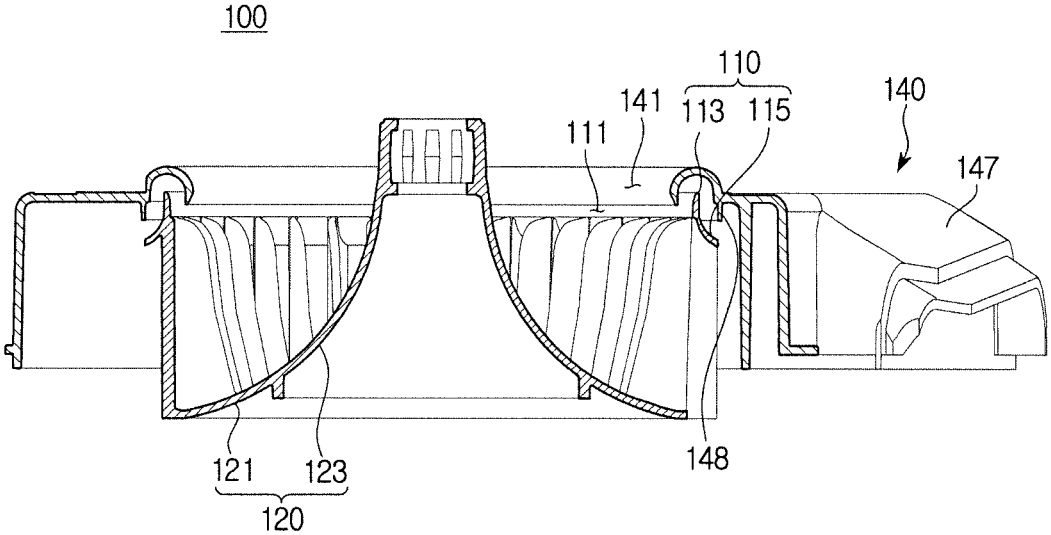

【Figure 7】
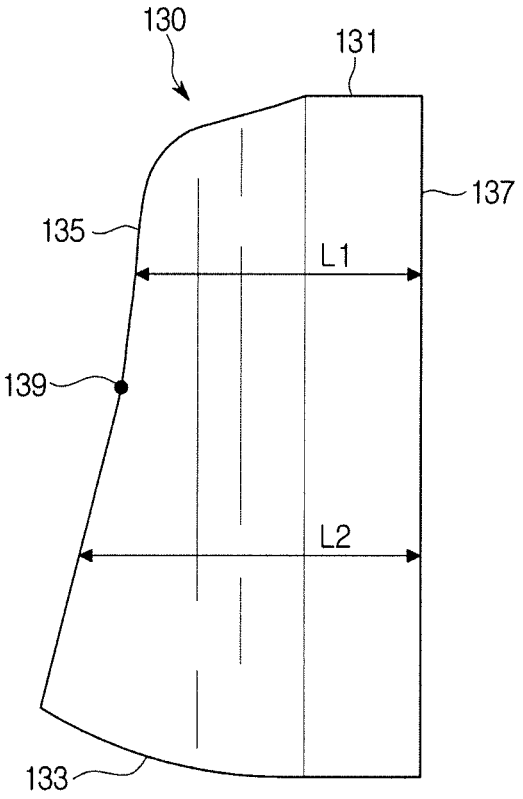

【Figure 8】
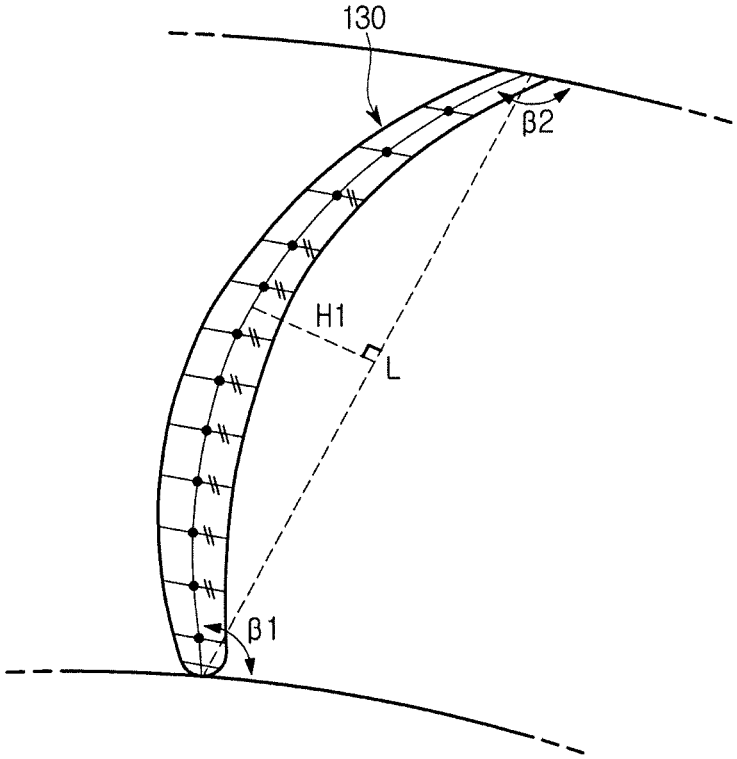

【Figure 9】
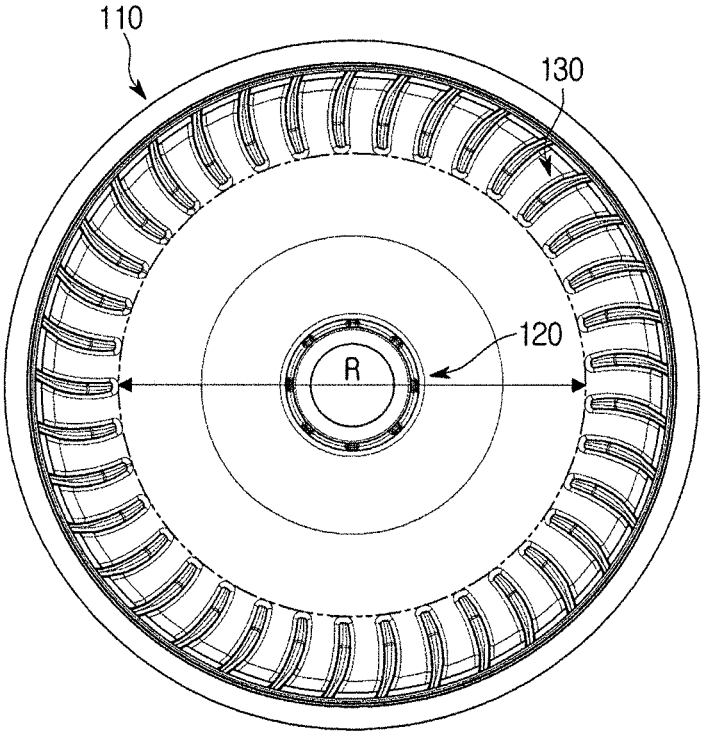

【Figure 10】
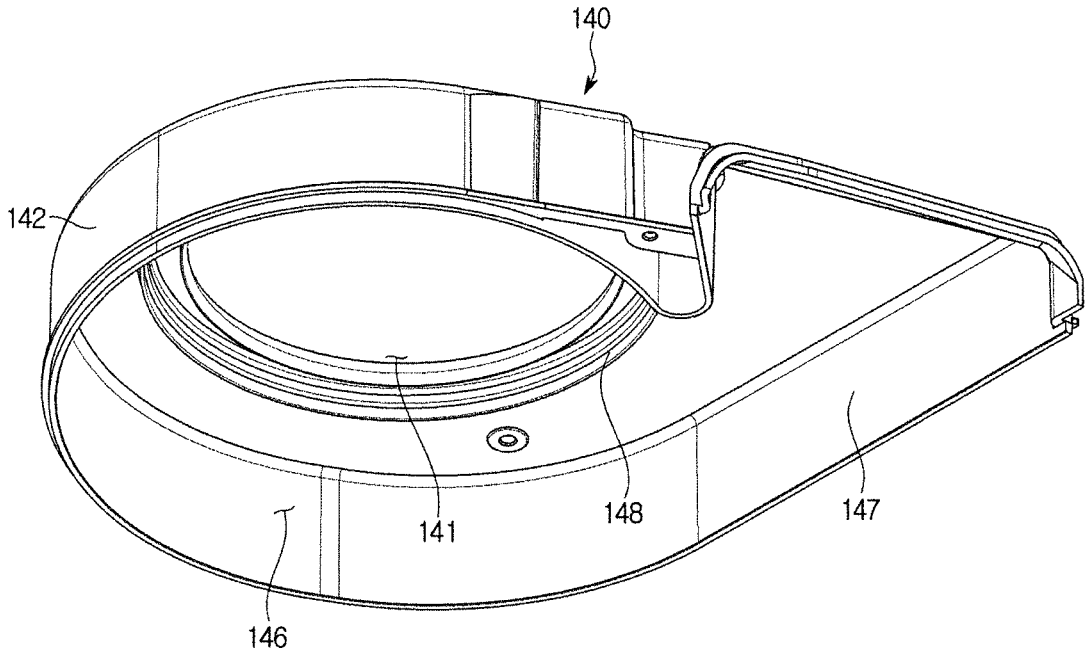

[Figure 11]
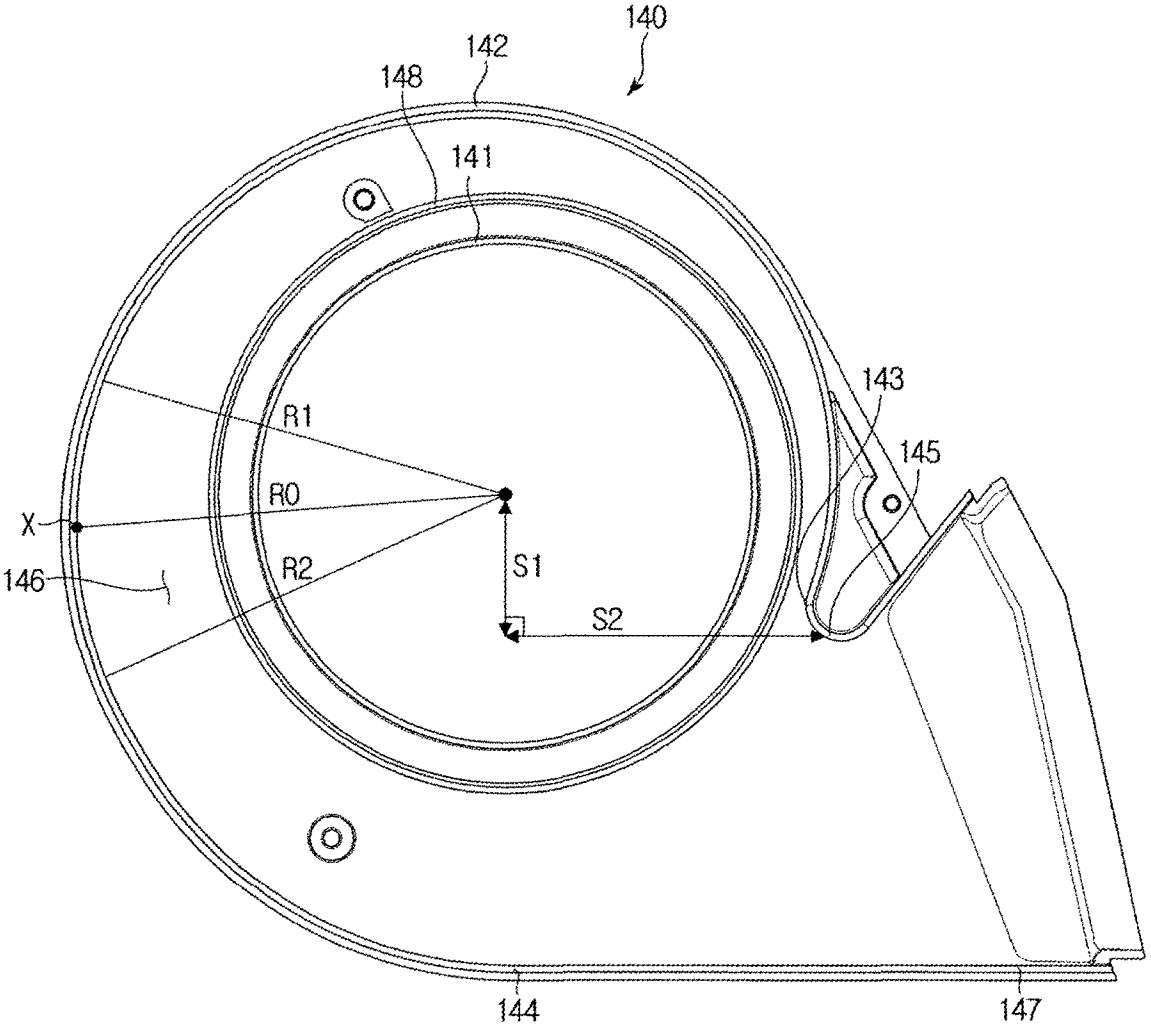

[Figure 12]
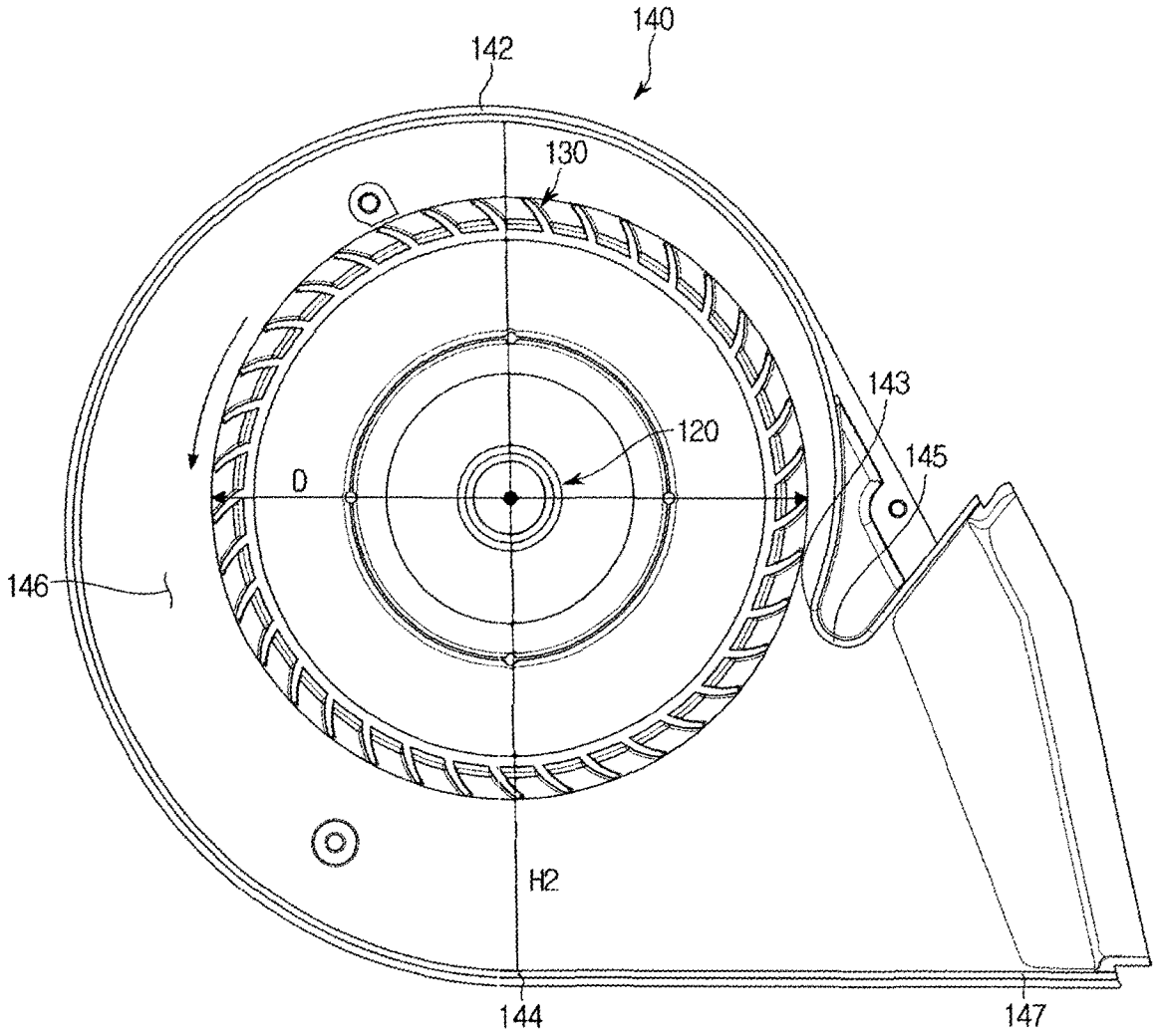

FAN ASSEMBLY AND WASHING MACHINE HAVING THE SAME

CROSS-REFERENCE TO RELATED APPLICATIONS

This application is a U.S. National Stage Application which claims the benefit under 35 U.S.C. § 371 of International Patent Application No. PCT/KR2017/014298 filed on Dec. 7, 2017, which claims foreign priority benefit under 35 U.S.C. § 119 of Korean Patent Application No. 10-2017-0008632 filed on Jan. 18, 2017 in the Korean Intellectual Property Office, the contents of both of which are incorporated herein by reference.

TECHNICAL FIELD

The present disclosure relates to a fan assembly having improved efficiency and a washing machine having the fan assembly.

BACKGROUND ART

Generally, a drying and washing machine is an apparatus capable of drying of wet objects in a drum by rotating the drum which accommodates the wet objects to be dried and allowing hot and dry air to pass through the inside of the drum.

The drying and washing machines are classified into an exhaust type and a circulation type according to a method of treating moisture absorbed from objects to be dried.

An exhaust type drying and washing machine discharges humid air flowing out from a drum to the outside through an exhaust duct.

A circulation type drying and washing machine uses a method of removing moisture by passing humid air flowing out from a drum through a heat exchanger and then circulating the air back into the drum.

Although the circulation type drying and washing machine cannot use gas as a heat source and mainly uses electricity because the flow of air forms a closed loop, and thus a relatively much maintenance cost is required, the circulation type drying and washing machine has an advantage in that an exhaust duct is not required because air circulates between objects to be dried in the drum and a heat pump type drying apparatus.

In the case of a drying and washing machine in which a heat pump type drying apparatus is used, a sirocco fan with fixed pressure characteristics is mainly used because the circulating air should pass through an evaporator and a compressor in a limited space and thus the flow path resistance is high.

The sirocco fan that includes a plurality of blades rotates inside a scroll to generate a pressure change to form a flow field.

In the case of the sirocco fan, the distribution of air flow changes due to the shape of the blades, thereby affecting the efficiency, drying performance, and noise generation of the sirocco fan.

DISCLOSURE

Technical Problem

The present disclosure is directed to providing a fan assembly having improved efficiency by improving the shape of a blade and a washing machine having the fan assembly.

Technical Solution

One aspect of the present disclosure provides a washing machine including a cabinet, a drum installed inside the cabinet, and a fan assembly to guide heated air into the drum, wherein the fan assembly includes a shroud provided with an air inlet hole, a hub rotated by a driving motor, a plurality of blades provided along a circumferential direction of the hub to guide the air introduced through the air inlet hole in the circumferential direction of the hub, and a scroll guiding the air guided in the circumferential direction of the hub into the drum and including a partition wall to prevent the air guided in the circumferential direction of the hub from being re-introduced into the air inlet hole, and the blade includes a shroud contact portion in contact with the shroud and a hub contact portion in contact with the hub, and an inflection point is formed between the shroud contact portion and the hub contact portion.

The portion between the shroud contact portion and the inflection point may be formed in a convex shape in a direction directing to the center of the hub, and the portion between the inflection point and the hub contact portion may be formed in a convex shape in a direction directing to the outside from the center of the hub.

If a straight line connecting opposite ends of the blade in the circumferential direction of the hub is L, a perpendicular distance from one point between the shroud contact portion and the inflection point to an outer side surface of the blade is L1, and a perpendicular distance from one point between the inflection point and the hub contact portion to the outer side surface of the blade is L2, the length of L2 may be provided to be longer than the length of L1.

If the length of the longest perpendicular distance of the blade to the straight line connecting the opposite ends of the blade is H1, H1 may be provided such that the portion between the inflection point and the hub contact portion is longer than the portion between the shroud contact portion and the inflection point.

The blade may satisfy $0.12 \leq H1/L \leq 0.17$ between the shroud contact portion and the inflection point and may satisfy $0.17 \leq H1/L \leq 0.2$ between the inflection point and the hub contact portion.

If a flow inlet angle at which air is introduced from one end of the blade adjacent to the center of the hub among the opposite ends of the blade in the circumferential direction of the hub is $\beta 1$ and a flow outlet angle at which air is discharged from the other end of the blade is $\beta 2$, the blade may satisfy $95° \leq \beta 1 \leq 105°$ and $140° \leq \beta 2 \leq 150°$.

If the inner diameter of the blade with respect to the center of the hub is R, the blade may satisfy $5 \leq R/L \leq 6$ between the shroud contact portion and the inflection point and may satisfy $3.5 \leq R/L \leq 4.5$ between the inflection point and the hub contact.

The scroll may include an opening formed to allow air to be introduced into the air inlet hole, an outer side wall formed such that the distance from the center of the opening gradually increases along the circumference of the opening, an accommodating portion formed by the outer side wall to accommodate the plurality of blades, and a guide portion to guide the air discharged to the accommodating portion into the drum.

The partition wall may be provided such that the rim of the air inlet hole is positioned between the partition wall and the rim of opening.

The partition wall may be provided such that the end of the partition wall is spaced apart from the shroud, and the vertical distance between the end of the partition wall and the shroud may be between 4.5 mm and 5 mm.

The outer side wall may include a first portion closest to the opening and a second portion farthest away from the opening, and the guide portion may be provided to extend from the first portion and the second portion.

If the outer diameter of the blade is D with respect to the center of the hub and the maximum length of the outer side wall passing through the center of the hub is H2, the relationship of H2 and D may be 1.4≤mm H2/D≤1.5 mm.

The first portion and the guide portion may be connected by a semicircular connecting portion.

If the vertical distance between the center of the opening and the connecting portion is S1 and the horizontal distance between the center of the opening and the connecting portion is S2, the relationship of S1 and S2 may be 0.4≤S1/S2≤0.5.

If an arbitrary point of the outer side wall is a point X and the distance from the center of the opening to the point X is R0, and when the distance to the center of the opening from one point where the distance from the center of the opening among the two points adjacent to the point X of the outer side wall is shorter than R0 is R1 and the distance to the center of the opening from the other point where the distance from the center of the opening is longer than R0 is R2, the relationship of R1 and R2 may be 0.9≤R1/R2≤1.

Advantageous Effects

According to the embodiments of the present disclosure, noise generation of the fan assembly can be reduced and efficiency can be improved.

DESCRIPTION OF DRAWINGS

FIG. 1 is a perspective view of a washing machine according to an embodiment of the present disclosure.

FIG. 2 is a schematic side cross-sectional view of a washing machine according to an embodiment of the present disclosure.

FIG. 3 illustrates the flow of refrigerant and air in a drying apparatus according to an embodiment of the present disclosure.

FIG. 4 is a perspective view of a fan assembly according to an embodiment of the present disclosure.

FIG. 5 is a view illustrating a scroll separated from the fan assembly according to an embodiment of the present disclosure.

FIG. 6 is a cross-sectional view of the fan assembly according to an embodiment of the present disclosure.

FIG. 7 schematically illustrates an inflection point formed between a shroud contact and a hub contact of a blade according to an embodiment of the present disclosure.

FIG. 8 is a top cross-sectional view of the blade according to an embodiment of the present disclosure.

FIG. 9 is a top view of a plurality of the blades according to an embodiment of the present disclosure.

FIG. 10 is a perspective view illustrating the inside of the scroll according to an embodiment of the present disclosure.

FIG. 11 is a plan view illustrating the inside of the scroll according to an embodiment of the present disclosure.

FIG. 12 is a plan view illustrating the inside of the scroll in which a fan is accommodated according to an embodiment of the present disclosure.

MODE FOR INVENTION

The embodiments described in the present specification and the configurations shown in the drawings are only examples of preferred embodiments of the present disclosure, and various modifications may be made at the time of filing of the present disclosure to replace the embodiments and drawings of the present specification.

Like reference numerals or signs in the respective drawings of the present specification represent parts or components that perform substantially the same functions.

The terms used in the present specification are for the purpose of describing the embodiments and are not intended to restrict and/or to limit the present disclosure. For example, the singular expressions herein may include plural expressions, unless the context clearly dictates otherwise. Also, the terms "comprises," "includes" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another. For example, without departing from the scope of the present disclosure, the first component may be referred to as a second component, and similarly, the second component may also be referred to as a first component. The term "and/or" includes any combination of a plurality of related items or any one of a plurality of related items.

The terms "front end," "rear end," "upper portion," "lower portion," "upper end" and "lower end" used in the following description are defined with reference to the drawings, and the shape and position of each component are not limited by these terms.

Hereinafter, embodiments according to the present disclosure will be described in detail with reference to the accompanying drawings.

FIG. 1 is a perspective view of a washing machine according to an embodiment of the present disclosure, FIG. 2 is a schematic side cross-sectional view of a washing machine according to an embodiment of the present disclosure, and FIG. 3 illustrates the flow of refrigerant and air in a drying apparatus according to an embodiment of the present disclosure.

As illustrated in FIGS. 1 and 2, a washing machine includes a cabinet 10 for forming an outer appearance, the cabinet 10 may include a top cover 11, a front cover 12 and side and rear covers 13, and a display 15 and a rotary switch 16 for controlling the washing machine may be disposed at an upper portion of the front cover 12.

The rotary switch 16 may be provided so that a user may grasp and rotate the rotary switch 16 to select a mode of the washing machine.

The display 15 may display an operation state of the washing machine and a manipulation state of the user.

A drum 20 in which laundry such as clothes is accommodated is rotatably installed inside the cabinet 10.

A door 14 which is provided on the front surface of the cabinet 10 is rotatably installed to the cabinet 10 to open and close a feeding entrance 21 provided at the front surface of the drum 20.

The inside of the drum 20 is connected to the feeding entrance 21 so that laundry may be put into or taken out the drum 20 when the feeding entrance 21 is opened through the door 14.

The washing machine is provided with a heat pump type drying apparatus 30 so that laundry that have been washed may be dried before it is taken out of the drum 20.

The heat pump type drying apparatus 30 includes a compressor 31, a condenser 32, an expansion device 33, and an evaporator 34, and a refrigerant circulates through the compressor 31, the condenser 32, the expansion device 33, and the evaporator 34.

The heat pump type drying apparatus 30 further includes a connection duct 35 connected to the drum 20, and the connection duct 35 connects a discharge port 36 provided on the front surface of the drum 20 forming the feeding entrance 21 and a suction port 37 provided on the rear surface of the drum 20 to circulate air.

As illustrated in FIG. 3, as the refrigerant circulates through the compressor 31, the condenser 32, the expansion device 33 and the evaporator 34 in the heat pump type drying apparatus 30, a cycle of compression-condensation-expansion-evaporation is formed.

The condenser 32 and the evaporator 34 may be provided in the form of a heat exchanger capable of heat exchange with air.

The compressor 31 compresses refrigerant gas to a high-temperature and high-pressure state and discharges it to the condenser 32, and the condenser 32 condenses the compressed refrigerant into a liquid phase and may radiate heat to the surroundings through the condensation process.

The expansion device 33 expands the liquid refrigerant in a high-temperature and high-pressure state condensed in the condenser 32 to liquid refrigerant in a low-pressure state.

The evaporator 34 evaporates the refrigerant expanded by the expansion device 33 and returns refrigerant gas in a low-temperature and low-pressure state to the compressor 31, and may absorb heat from the surroundings through the evaporation process of changing the refrigerant liquid to the refrigerant gas.

The air circulating through the inside of the drum 20 through the connection duct 35 passes through the condenser 32 and becomes a high temperature dry air.

The high temperature dry air is guided by a fan assembly 100, which will be described later, and the air guided by the fan assembly 100 is introduced into the drum 20 through the suction port 37 to dry the laundry.

The air that has absorbed moisture from the laundry becomes a high temperature humid air containing a large amount of water vapor again, and the high temperature humid air discharged from the drum 20 through the discharge port 36 passes through the evaporator 34.

The discharge port 36 may be provided with a filter 38 for collecting foreign substances generated in the laundry.

The air that has passed through the evaporator 34 and has radiated heat is lowered in temperature and the amount of water vapor contained therein is reduced, and the high temperature humid air discharged from the drum 20 turns into a low temperature dry air while passing through the evaporator 34.

The air that has been dried and lowered in temperature while passing through the evaporator 34 again turns into a high temperature dry air while passing through the condenser 32, and then sucked into the drum 20.

FIG. 4 is a perspective view of a fan assembly according to an embodiment of the present disclosure, FIG. 5 is a view illustrating a scroll separated from the fan assembly according to an embodiment of the present disclosure, FIG. 6 is a cross-sectional view of the fan assembly according to an embodiment of the present disclosure, FIG. 7 schematically illustrates an inflection point formed between a shroud contact and a hub contact of a blade according to an embodiment of the present disclosure, FIG. 8 is a top cross-sectional view of the blade according to an embodiment of the present disclosure, and FIG. 9 is a top view of a plurality of the blades according to an embodiment of the present disclosure.

As illustrated in FIGS. 2 to 6, the fan assembly 100 includes a ring-shaped shroud 110 formed with an air inlet hole 111, a hub 120 rotated by a driving motor 150, a plurality of blades 130 spaced apart from each other by a predetermined distance along a circumferential direction of the hub 120, and a scroll 140 for guiding the air guided in the circumferential direction of the hub 120 by the blades 130 to the inside of the drum 20.

In the fan assembly 100, the shroud 110, the hub 120, and the blades 130 except for the scroll 140 form a single fan.

The shroud 110 is formed to have a ring shape, and may include the circular air inlet hole 111 formed at the center thereof, a first guide portion 113 forming the air inlet hole 111 and guiding the air introduced into the air inlet hole 111 in the axial direction of the hub 120, and a second guide portion 115 for guiding the air guided in the axial direction of the hub 120 by the first guide portion 113 in the circumferential direction of the hub 120.

The air discharged from the inside of the drum 20 through the discharge port 36 of the connection duct 35 moves along the connection duct 35 and flows into the air inlet hole 111 via the evaporator 34 and the condenser 32, and the air that has flowed into the air inlet hole 111 may be supplied into the drum 20 through the suction port 37 of the connection duct 35 by being guided by the fan assembly.

The hub 120 is connected to the driving motor 150 to be rotated by the driving motor 150, and may include a base 121 coupled to a portion of a lower surface of each of the plurality of blades 130, and a protrusion 123 provided to protrude toward the driving motor 150 at the center of the base 121 to be connected to the driving motor 150.

When the driving motor 150 is driven, the hub 120 is rotated by the driving motor 150, and when the hub 120 is rotated, the blades 130 coupled to the base 121 of the hub 120 and the shroud 110 coupled to an upper surface of the blades 130 are rotated about the protrusion 123 of the hub 120.

The blades 130 are provided to be spaced apart from each other by the predetermined distance along the circumferential direction of the hub 120 and are rotated together with the hub 120.

The plurality of blades 130 arranged along the circumferential direction of the hub 120 guides the air introduced through the air inlet hole 111 in the circumferential direction of the hub 120.

As illustrated in FIGS. 5 to 7, the blades 130 each include a shroud contact portion 131 that is in contact with the shroud 110 and a hub contact portion 133 that is in contact with the hub 120, and an inflection point 135 may be formed between the shroud contact portion 131 and the hub contact portion 133.

The blades 130 each may include the shroud contact portion 131 that is in contact with the shroud 110, the hub contact portion 133 that is in contact with the hub 120, an inner side portion 135 which is an inner surface directing to the protrusion 123 provided at the center of the hub 120 among the surfaces between the shroud contact portion 131 and the hub contact portion 133, and an outer side portion 137 which is an outer surface among the surfaces between the shroud contact portion 131 and the hub contact portion 133.

The inflection point 139 is formed on the inner side portion 135 of the blade 130, the inner side portion 135 between the shroud contact portion 131 and the inflection point 139 with respect to the inflection point 139 may be formed to have a convex shape in a direction directing to the projection 123 provided at the center of the hub 120, and the inner side portion 135 between the inflection point 139 and the hub contact portion 133 may be formed to have a convex shape in a direction directing to the outside from the center of the hub 120.

Because the inflection point 139 is formed between the shroud contact portion 131 and the hub contact portion 133 and the inner side portion 135 between the inflection point 139 and the hub contact portion 133 has a convex shape in a direction directing to the outside from the center of the hub 120, the length of the hub contact portion 133 may become longer than that of a case where the inflection point 139 is not formed between the shroud contact portion 131 and the hub contact portion 133.

In other words, as illustrated in FIGS. 6 to 9, when a straight line connecting opposite ends of the blade 130 in the circumferential direction of the hub 120 is L, a perpendicular distance from one point between the shroud contact portion 131 and the inflection point 139 to the outer side surface of the blade 130 is L1, and a perpendicular distance from one point between the inflection point 139 and the hub contact portion 133 to the outer side surface of the blade 130 is L2, because the inner side portion 135 between the shroud contact portion 131 and the inflection point 139 has a convex shape in a direction directing to the center of the hub 120, and the inner side portion 135 between the inflection point 139 and the hub contact portion 133 has a convex shape in a direction directing to the outside from the center of the hub 120, the length of L2 is provided to be longer than the length of L1.

Because the length of L2 is provided to be longer than the length of L1 and becomes longer from the inflection point 139 toward the hub contact portion 133, the length of the hub contact portion 133 may be longer than that of the case where the inflection point 139 is not formed between the shroud contact portion 131 and the hub contact portion 133.

When the length of the hub contact portion 133 where the blade 130 contacts the hub 120 becomes long, the area of the hub contact portion 133 is increased, and when the area of the hub contact portion 133 becomes increased, the rigidity of a fan may be increased when the fan rotates at a high speed of 3000 rpm or more.

If the length of the longest perpendicular distance of the blade 130 to the straight line L connecting the opposite ends of the blade 130 is H1, H1 may be provided such that the portion between the inflection point 139 and the hub contact portion 133 is longer than the portion between the shroud contact portion 131 and the inflection point 139.

It is preferable that the blade 130 satisfies $0.12 \leq H1/L \leq 0.17$ between the shroud contact portion 131 and the inflection point 139 and satisfies $0.17 \leq H1/L \leq 0.2$ between the inflection point 139 and the hub contact portion 133.

If a flow inlet angle at which air is introduced from one end of the blade 130 adjacent to the center of the hub 120 among the opposite ends of the blade 130 in the circumferential direction of the hub 120 is $\beta 1$ and a flow outlet angle at which air is discharged from the other end of the blade 130 is $\beta 2$, it is preferable that the blade 130 satisfies $95° \leq \beta 1 \leq 105°$ and $140° \leq \beta 2 \leq 150°$.

If the inner diameter of the plurality of blades 130 arranged along the circumferential direction of the hub 120 is R, it is preferable that the blade 130 satisfies $5 \leq R/L \leq 6$ between the shroud contact portion 131 and the inflection point 139 and satisfies $3.5 \leq R/L \leq 4.5$ between the inflection point 139 and the hub contact 133.

FIG. 10 is a perspective view illustrating the inside of the scroll according to an embodiment of the present disclosure, FIG. 11 is a plan view illustrating the inside of the scroll according to an embodiment of the present disclosure, and FIG. 12 is a plan view illustrating the inside of the scroll in which a fan is accommodated according to an embodiment of the present disclosure.

As illustrated in FIG. 6 and FIGS. 10 to 12, the scroll 140 may include an opening 141 formed to allow air to be introduced into the air inlet hole 111 of the shroud 110, an outer side wall 142 formed such that the distance from the center of the opening 141 gradually increases along the circumference of the opening 141, an accommodating portion 146 formed by the outer side wall 142 to accommodate the fan, a guide portion 147 to guide the air discharged to the accommodating portion 146 by the blades 130 into the drum 20, and a partition wall 148 to prevent the air guided in the circumferential direction of the hub 120 by the blades 130 from being re-introduced into the air inlet hole 111.

The opening 141 is formed in a circular shape corresponding to the air inlet hole 111 of the shroud 110 and allows air to be introduced into the air inlet hole 111 of the fan accommodated in the scroll 140.

The air discharged from the drum 20 through the discharge port 36 of the connection duct 35 moves along the connection duct 35, and the air passing through the evaporator 34 and the condenser 32 may be introduced into the air inlet hole 111 of the shroud 110 through the opening 141 of the scroll 140 (refer to FIG. 2).

The outer side wall 142 may be spaced a certain distance from the opening 141 along the circumference of the opening 141.

The outer side wall 142 includes a first portion 143 closest to the opening 141, a second portion 144 farthest away from the opening 141, and a semicircular connecting portion 145 connecting the first portion 143 and the guide portion 147, and the distance from the center of the opening 141 to the outer side wall 142 gradually increases from the first portion 143 toward the second portion 144.

The direction from the first portion 143 toward the second portion 144 is the direction in which the blades 130 rotate and the direction in which the blades 130 rotate is the direction indicated by the arrow in FIG. 12.

Accordingly, the outer side wall 142 may be provided such that the distance from the center of the opening 141 gradually increases along the direction in which the blades 130 rotate.

If the outer diameter of the blade 130 is D with respect to the center of the hub 120 and the maximum length of the outer side wall 142 passing through the center of the hub 120 is H2, it is preferable to satisfy $1.4\ mm \leq H2/D \leq 1.5\ mm$.

Further, when an arbitrary point of the outer side wall 142 is a point X and the distance from the center of the opening 141 to the point X is R0, and when the distance to the center of the opening 141 from one point where the distance from the center of the opening 141 among the two points adjacent to the point X of the outer side wall 142 is shorter than R0 is R1 and the distance to the center of the opening 141 from the other point where the distance from the center of the opening 141 is longer than R0 is R2, it is preferable to satisfy $0.9 \leq R1/R2 \leq 1$.

The accommodating portion 146 in which the fan is accommodated is a space formed inside the scroll 140 by the outer side wall 142 and may communicate with the guide portion 147.

The air introduced into the air inlet hole 111 of the shroud 110 moves to the accommodating portion 146 by being guided in the circumferential direction of the hub 120 by the blades 130, and the air that has moved to the accommodating portion 146 moves to the guide portion 147 communicated with the accommodating portion 146 and then may be sucked into the drum 20 by being guided by the guide portion 147 (refer to FIG. 2).

The guide portion 147 extends from the first portion 143 and the second portion 144 of the outer side wall 142 so that the air that has moved to the accommodating portion 146 may be sucked into the drum 20, and the guide portion 147 and the first portion 143 may be connected by a connecting portion 145.

If the vertical distance between the center of the opening 141 and the connecting portion 145 is S1 and the horizontal distance between the center of the opening 141 and the connecting portion 145 is S2, it is preferable to satisfy $0.4 \leq S1/S2 \leq 0.5$.

While the air guided in the circumferential direction of the hub 120 by the blades 130 moves along the accommodating portion 146 and the guide portion 147 and is sucked into the drum 20, a part of the air guided in the circumferential direction of the hub 120 by the blades 130 does not move along the accommodating portion 146 and the guide portion 147 but may be re-introduced into a space between the shroud 110 and the scroll 140 due to a pressure difference with the air quickly introduced through the opening 141 and the air inlet hole 111.

When air does not move along the accommodating portion 146 and the guide portion 147 and is re-introduced into the space between the shroud 110 and the scroll 140, noise is generated and the efficiency of the fan may be lowered.

In order to prevent such a problem, the scroll 140 may be provided with a partition 148 that prevents air from being re-introduced into the space between the shroud 110 and the scroll 140.

The partition wall 148 may be provided such that the rim of the air inlet hole 111 is positioned between the partition wall 148 and the rim of opening 141.

Because the partition wall 148 is provided in the space between the shroud 110 and the scroll 140, a part of the space between the shroud 110 and the scroll 140 is blocked by the partition wall 148 so that the amount of air that is re-introduced into the space between the shroud 110 and the scroll 140 may be minimized.

In this case, the partition wall 148 is formed such that the end of the partition wall 148 is spaced apart from the shroud 110 to block only a part of the space between the shroud 110 and the scroll 140, and it is preferable that the vertical distance between the end of the partition wall 148 and the shroud 110 is between 4.5 mm and 5 mm.

While the particular embodiments of the present disclosure have been described for illustrative purposes, those skilled in the art will appreciate that various modifications, additions and substitutions are possible, without departing from the scope and spirit of the disclosure as disclosed in the accompanying claims.

The invention claimed is:

1. A washing machine comprising:
a cabinet;
a drum installed inside the cabinet; and
a fan assembly to guide air into the drum,
wherein the fan assembly includes:
a shroud provided with an air inlet hole;
a hub configured to be rotated by a driving motor;
a blade configured to rotate with the hub and guide air introduced through the air inlet hole; and
a scroll configured to guide air guided by the blade into the drum and including a partition wall to prevent the air guided by the blade from being re-introduced into the air inlet hole,
wherein the blade includes a shroud contact portion in contact with the shroud and a hub contact portion in contact with the hub, and an inflection point is formed between the shroud contact portion and the hub contact portion.

2. The washing machine according to claim 1, wherein
a portion between the shroud contact portion and the inflection point is formed in a convex shape in a direction directing to a rotational center of the hub, and a portion between the inflection point and the hub contact portion is formed in a convex shape in a direction directing to the outside from the rotational center of the hub.

3. The washing machine according to claim 2, wherein
when a straight line connecting opposite ends of the blade in a radial direction of the hub is L, L is provided such that a length of the straight line between the inflection point and the hub contact portion is longer than a length of the straight line between the shroud contact portion and the inflection point.

4. The washing machine according to claim 3, wherein
when a length of a longest perpendicular distance of the blade to the straight line connecting the opposite ends of the blade is H1, H1 is provided such that a portion between the inflection point and the hub contact portion is longer than a portion between the shroud contact portion and the inflection point.

5. The washing machine according to claim 4, wherein
the blade satisfies $0.12 \leq H1/L \leq 0.17$ between the shroud contact portion and the inflection point and satisfies $0.17 \leq H1/L \leq 0.2$ between the inflection point and the hub contact portion.

6. The washing machine according to claim 5, wherein
when a flow inlet angle at which air is introduced from a first end of the blade adjacent to the rotational center of the hub among the opposite ends of the blade is $\beta 1$ and a flow outlet angle at which air is discharged from a second end of the blade is $\beta 2$, the blade satisfies $95° \leq \beta 1 \leq 105°$ and $140° \leq \beta 2 \leq 150°$.

7. The washing machine according to claim 5, wherein
when an inner diameter of the blade with respect to the rotational center of the hub is R, the blade satisfies $5 \leq R/L \leq 6$ between the shroud contact portion and the inflection point and satisfies $3.5 \leq R/L \leq 4.5$ between the inflection point and the hub contact portion.

8. The washing machine according to claim 1, wherein
the scroll includes an opening formed to allow air to be introduced into the air inlet hole, an outer side wall formed such that a distance from a center of the opening gradually increases along a circumference of the opening, an accommodating portion formed by the outer side wall to accommodate the blade, and a guide portion to guide air discharged to the accommodating portion into the drum.

9. The washing machine according to claim 8, wherein
the partition wall is provided such that a rim of the air inlet hole is positioned between the partition wall and a rim of opening.

10. The washing machine according to claim 9, wherein
the partition wall is provided such that an end of the partition wall is spaced apart from the shroud, and a perpendicular distance between the end of the partition wall and the shroud is between 4.5 mm and 5 mm.

11. The washing machine according to claim 8, wherein the outer side wall includes a first portion closest to the opening and a second portion farthest away from the opening, and the guide portion is provided to extend from the first portion and the second portion.

12. The washing machine according to claim 11, wherein when an outer diameter of the blade is D with respect to a rotational center of the hub and a maximum length to the outer side wall passing through the rotational center of the hub is H2, the relationship of H2 and D is 1.4 mm≤H2/D≤1.5 mm.

13. The washing machine according to claim 11, wherein the first portion and the guide portion are connected by a semicircular connecting portion.

14. The washing machine according to claim 13, wherein when a vertical distance between the center of the opening and the semicircular connecting portion is S1 and a horizontal distance between the center of the opening and the semicircular connecting portion is S2, the relationship of S1 and S2 is 0.4≤S1/S2≤0.5.

* * * * *